United States Patent [19]

Pisacane et al.

[11] Patent Number: 4,818,001

[45] Date of Patent: Apr. 4, 1989

[54] CHAMBER DOOR LOCK

[75] Inventors: Louis F. Pisacane, Churchville; William F. Mitchell, Huntington Valley, both of Pa.

[73] Assignee: Environmental Tectonics Corporation, Southampton, Pa.

[21] Appl. No.: 41,174

[22] Filed: Apr. 22, 1987

[51] Int. Cl.[4] ..... E05C 9/02

[52] U.S. Cl. ..... 292/304; 49/255

[58] Field of Search ..... 292/304, 336.3, 35, 292/DIG. 36; 49/255, 256

[56] References Cited

U.S. PATENT DOCUMENTS

| | | | |
|---|---|---|---|
| 767,796 | 8/1904 | Chaddock | 49/255 X |
| 2,843,887 | 7/1958 | Hederus | 292/DIG. 47 X |
| 3,346,992 | 10/1967 | Lodge | 49/255 |
| 4,618,177 | 10/1986 | Schultz | 292/DIG. 36 X |

*Primary Examiner*—Richard E. Moore

*Attorney, Agent, or Firm*—Panitch Schwarze Jacobs & Nadel

[57] ABSTRACT

A chamber door lock for a roller lock system wherein a vertically reciprocable locking bar is provided with a series of rollers and a vertically reciprocable chamber door is provided with spaced block weldments. The chamber door lock includes a cam beam pivotably mounted on the chamber and coupled to the locking bar. Upward movement of the locking bar to its uppermost position clears the rollers from the door block weldments and swings the cam beam away from the top of the door to a clearance position whereby the chamber door can be raised and swung to an open position. Downward movement of the locking bar to its lowermost position moves the rollers into engagement with striker plates on the door block weldments thereby urging the door against the chamber face so as to compress the door gasket and seal the chamber face. Downward movement of the locking bar also swings the cam beam from the clearance position past an over-the-center position to a limit stop position wherein the cam beam is located at a slight clearance above the top of the door. Upward movement of the door then forces the cam beam against a stop so that any further movement of the door is obstructed by the cam beam.

14 Claims, 6 Drawing Sheets

FIG. 1
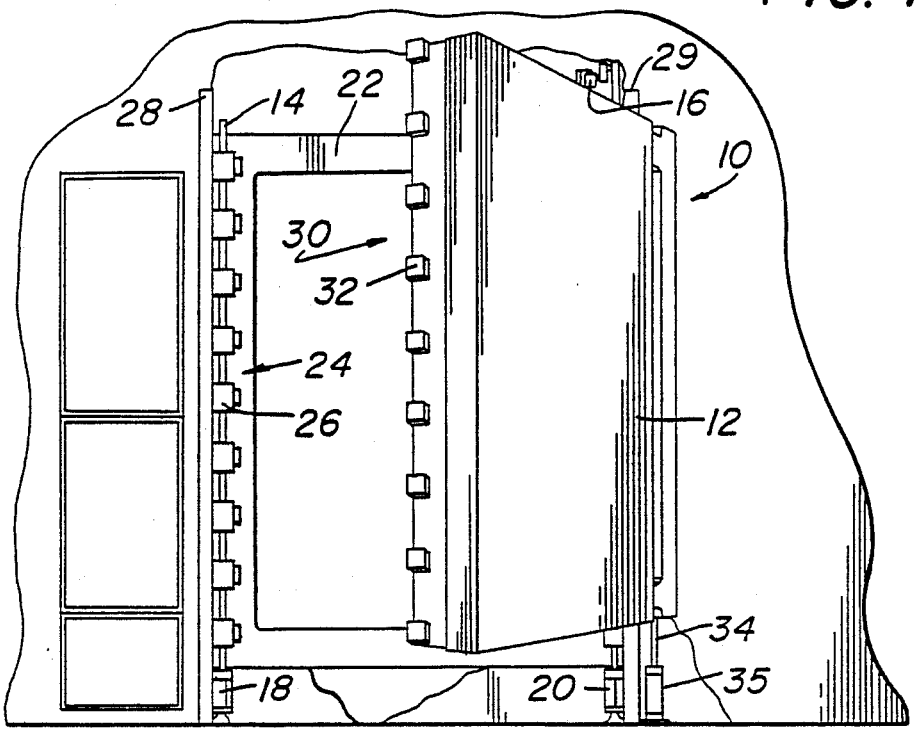
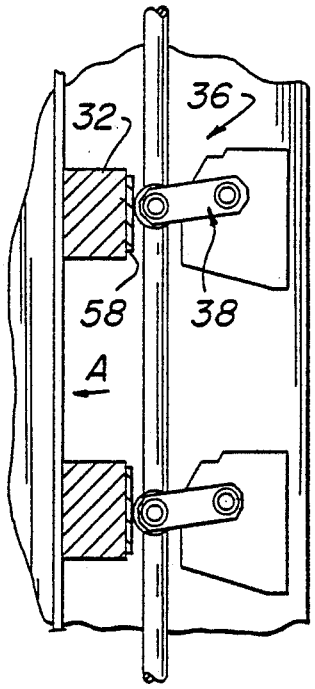
FIG. 2

78
72
70
76
64
60
62
82
14
(16)
80
12

CHAMBER DOOR LOCK

BACKGROUND OF THE INVENTION

The present invention is directed to a chamber door lock for a hydraulically operated roller lock system. Such a system is described for example in Environmental Tectonics Corporation data sheet 901D-686-3M titled "Roller Lock Door System". In such a system, the chamber door is mounted on a "C" frame journaled on a hinge pin which is vertically movable between up and down positions by a hydraulic cylinder. Each side of the door is provided with a column of spaced door block weldments. A column of spaced chamber block weldments is also mounted on each side of the chamber face, in juxtaposition with the door block weldments. The chamber block weldments are stationary. A locking bar is located on each side of the chamber face near the chamber block weldments. Each locking bar is vertically movable between up and down positions by means of a hydraulic cylinder. A column of spaced roller assemblies is coupled to each locking bar for vertical movement therewith. Each roller assembly includes an arm. The arm is pivotably mounted at one end on a chamber block weldment and supports a roller at its other end coupled to the locking bar.

To open the chamber face, the locking bars are raised by their hydraulic cylinders and then the door cylinder is actuated to lift the hinge pin and door to an uppermost position wherein the door block weldments clear the raised locking bar rollers. The chamber door is then swung on the hinge pin away from the chamber face. The door block weldments pass through the spaces between the chamber block weldments on each side of the chamber face. To seal the chamber, the door is swung on the hinge pin against the chamber face while the locking bars are raised. The door block weldments pass through the spaces between the chamber block weldments on each side of the chamber face. The door cylinder is then actuated to pull the hinge pin and door downwardly so that the door block weldments are aligned with and are behind the chamber block weldments. This prevents the door from being swung open and brings the door gasket in position along the periphery of the chamber face opening. To seal the chamber face, the locking bar cylinders are actuated to pull the locking bars downwardly thereby pivoting the roller assembly arms downwardly until the arms are below their horizontal or center positions. The rollers contact the door block weldments on both sides of the door and urge the door against the chamber face while compressing the door gasket.

When each locking bar reaches the lowermost position, it trips a limit switch thereby allowing the chamber to be pressurized via an operator control. The chamber pressure tends to urge the door away from the chamber face thereby urging the door block weldments against the rollers. The door block weldments assist in holding the locking bars in their lowermost positions because the force exerted on the rollers tends to keep the roller assembly arms below their center positions.

If the chamber door has not been lowered to its lowermost position when the locking bar cylinders are actuated, the rollers may override the door block weldments and lock up on the weldment bottom edges as the locking bars reach their lowermost positions. The roller arms are essentially locked below their center positions but the rollers are not correctly positioned relative to the door block weldments. When the chamber is pressurized, the chamber pressure tends to force the door outwardly whereby the door block weldments may ride over the rollers allowing the door to separate from the chamber.

Also, although the locking bars and chamber door may be brought to their lowermost positions, so that a proper seal is obtained at the chamber face before the chamber is pressurized, an operator may mistakenly attempt to raise the chamber door (by actuating the door cylinder) without first raising the locking bars. If the door is raised sufficiently, the door block weldments may clear the rollers whereby the chamber pressure can cause the door to separate from the chamber face.

The problems solved by the present invention are that of preventing the chamber from being pressurized unless the chamber door and locking bars are in their lowermost positions so that the chamber face is properly sealed, and that of preserving the seal by preventing the chamber door from being raised while the chamber is pressurized.

BRIEF SUMMARY OF THE INVENTION

Locking apparatus for a chamber door movable vertically between up and down positions and against the chamber face, comprising a locking bar movable vertically between up and down positions, and means coupled to said locking bar for obstructing upward movement of said door when said door and locking bar are in said down positions and for permitting unobstructed upward movement of said door when said locking bar is in said up position.

Locking apparatus for a chamber door movable vertically between up and down positions and against the chamber face, comprising a locking bar movable vertically between up and down positions, and means coupled to said locking bar for obstructing downward movement of said locking bar when said door is above said down position and for permitting unobstructed downward movement of said locking bar when said door is in said down position.

Locking apparatus for a chamber door movable vertically between up and down positions and against a chamber face, comprising a locking bar movable vertically between up and down positions, and means coupled to said locking bar for cammingly contacting the door as said locking bar moves downwardly and said door is near but not at said down position whereby said door is urged to said down position.

BRIEF DESCRIPTION OF THE DRAWINGS

FIG. 1 is a front elevation of a pressure chamber including a conventional roller lock door system and a chamber door lock according to the present invention.

FIG. 2 is a side view taken along 2—2 in FIG. 3 and showing the door block weldments, the locking bar, the roller assemblies, and the chamber block weldments.

DETAILED DESCRIPTION OF THE INVENTION

Figure 3:
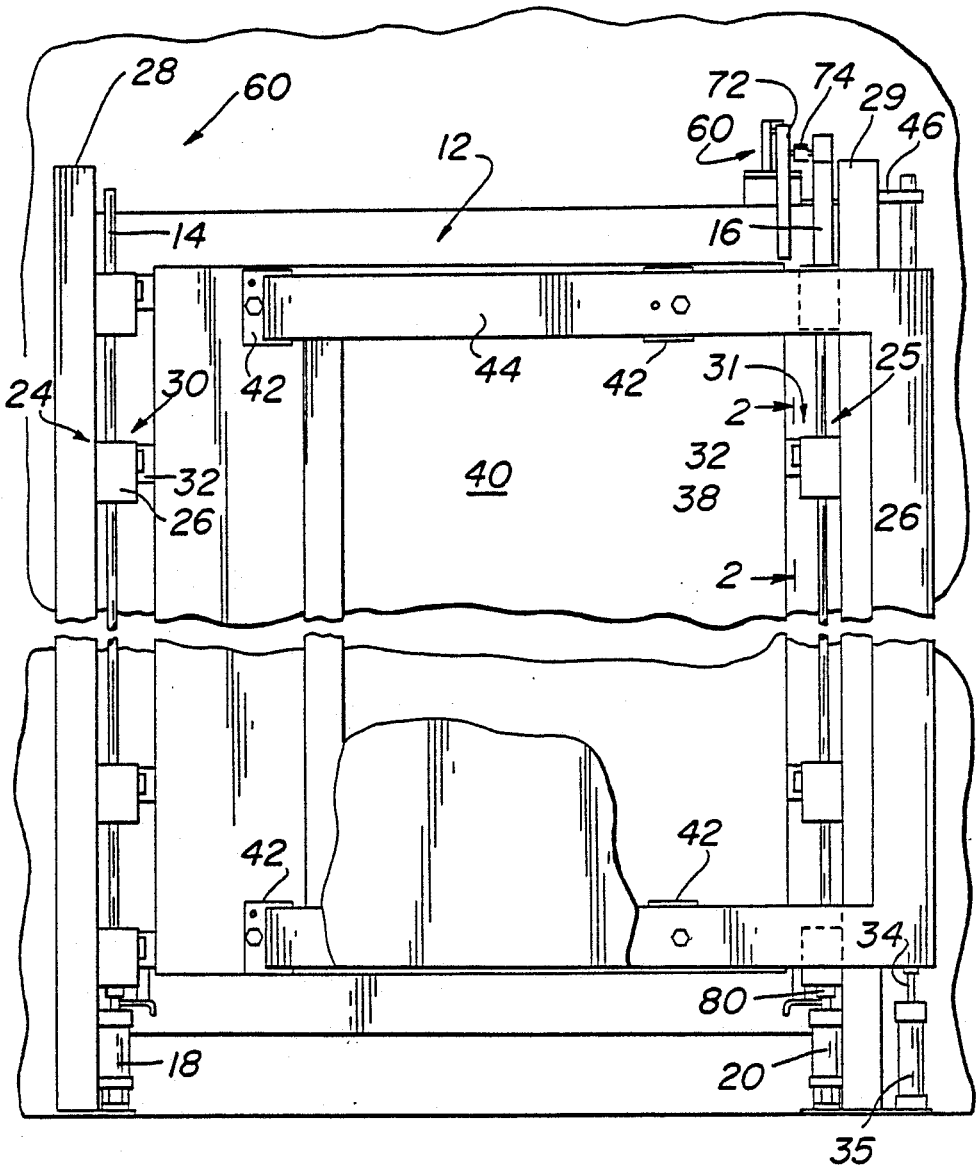
FIG. 3 is a front elevation of the chamber door and locking bar and associated hydraulic cylinders.

Referring to the drawings, wherein like numerals indicate like elements, there is shown in FIG. 1 a pressure chamber 10 provided with a chamber door 12 and a pair of locking bars 14, 16. The locking bars are vertically movable between up and down positions by means of hydraulic cylinders 18, 20 and are located on each side (left, right) of the chamber face 22. Adjacent each locking bar is a column 24 (25) of spaced chamber block weldments 26 secured to the inside face of a chamber side plate 28 (29). Each side (left, right) of the chamber door 12 is provided with a column 30 (31) of spaced door block weldments 32. The chamber door 12 is mounted on a hinge pin 34 and is vertically movable, together with the hinge pin, between up and down positions by means of hydraulic cylinder 35 which is coupled in conventional manner by a clevis to the hinge pin.

Referring to FIG. 2, a column 36 of spaced roller assemblies 38 are mounted on each locking bar 14 (16) and the adjacent chamber block weldments 26. As shown in FIG. 2, as the locking bars descend, the roller assemblies 38 contact the adjacent door block weldments 32 when door 12 is closed against the chamber face and in its lowermost position. The roller assemblies thereby urge the door against the chamber face, as shown by arrow A, whereby the door gasket is fully compressed against the chamber face to seal the chamber.

The chamber door 12 is shown in greater detail in FIG. 3. The door 12 includes a body 40 attached by mounting brackets 42 to a "C" frame 44 of conventional structure. The "C" frame pivots about hinge pin 34. The hinge pin is journaled in the "C" frame and a bearing block 46 secured to the chamber side plate.

Figure 4A:
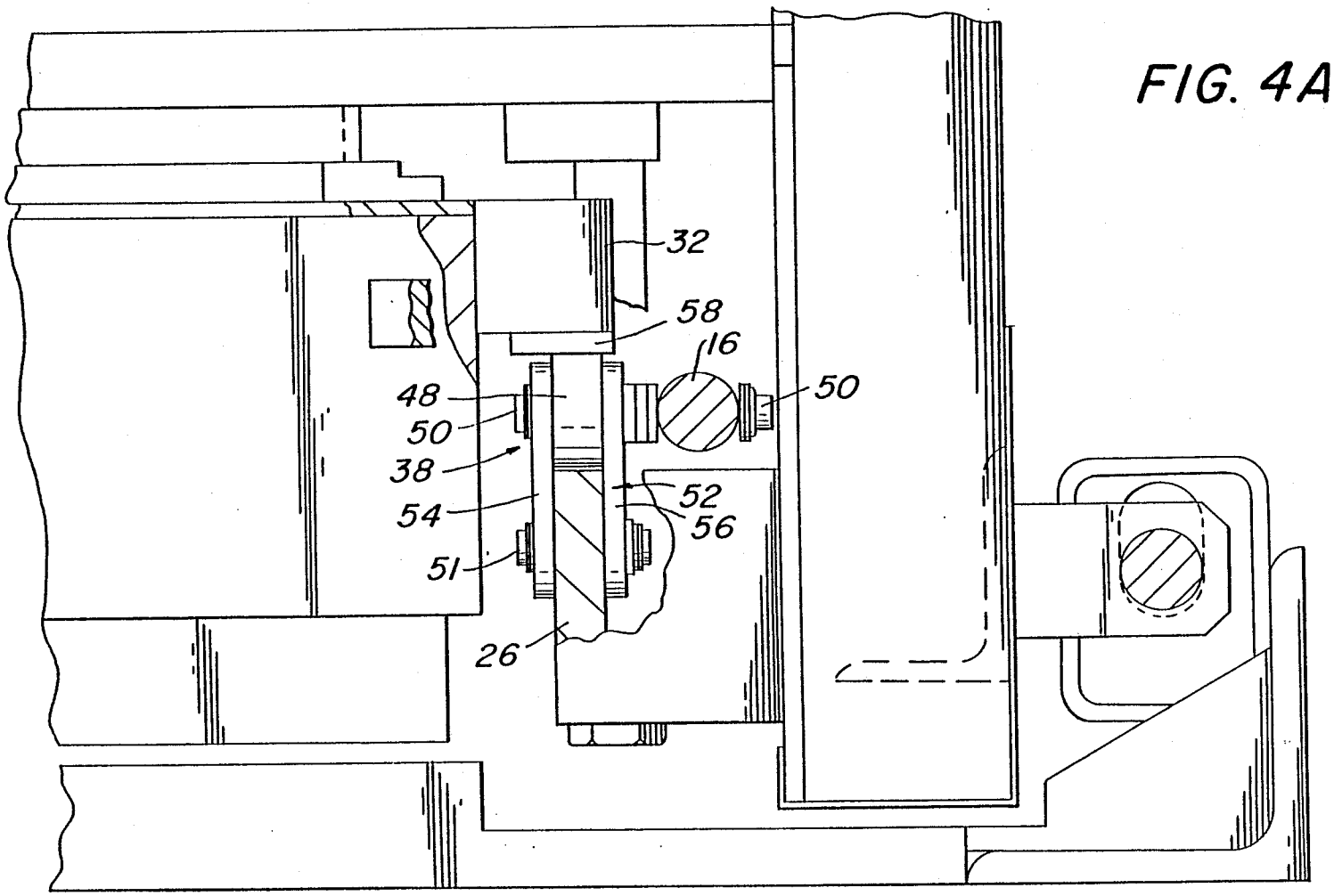
FIGS. 4A and 4B comprise an enlarged plan view showing the door and chamber block weldments, both locking bars and roller assemblies, and a door lock according to the present invention for each locking bar.
Figure 4B:
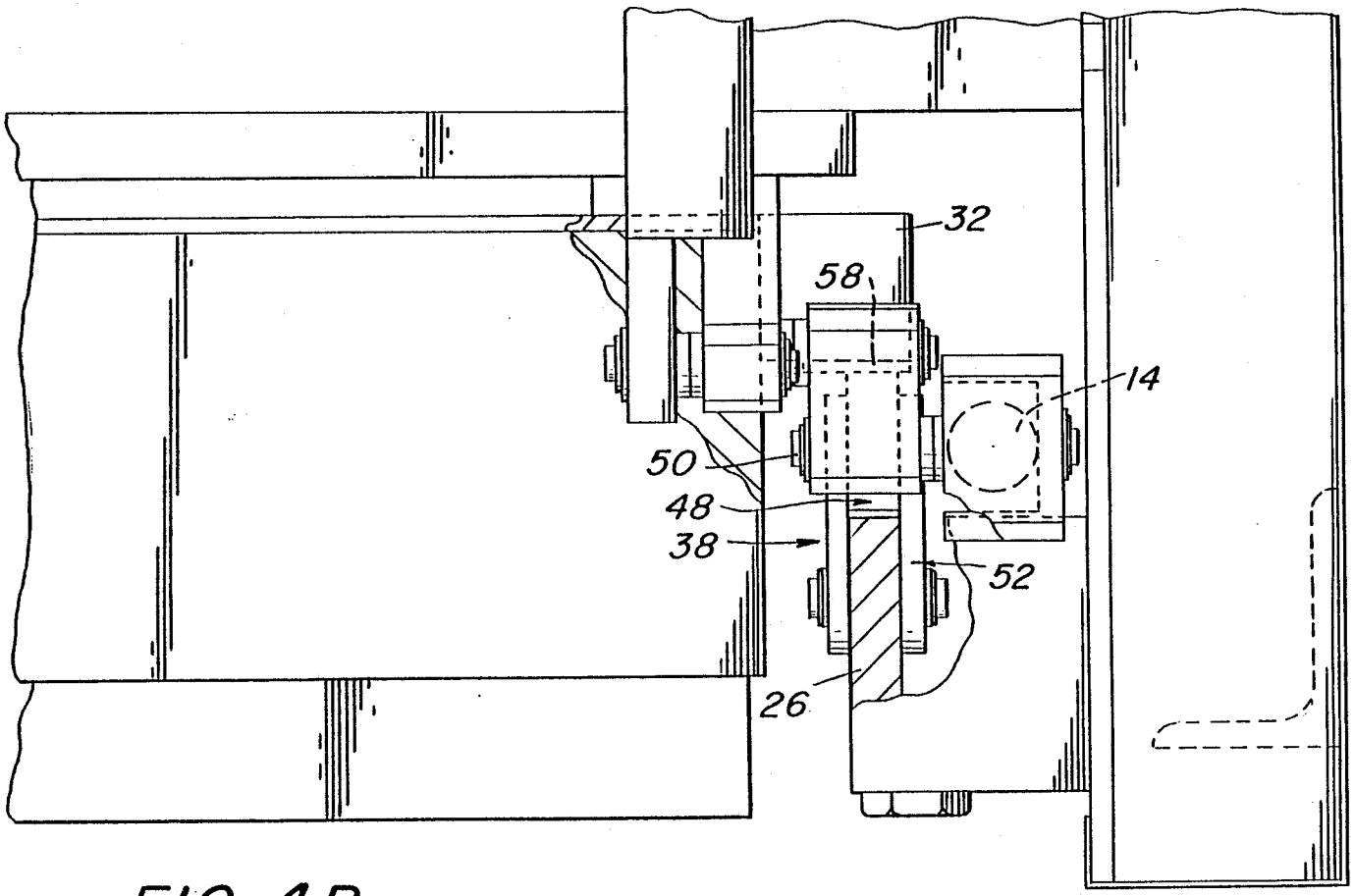

The roller assemblies 38 and locking bars 14, 16 are shown in juxtaposition with the chamber block weldments 26 and door block weldments 32 in FIGS. 4A and 4B. Each roller assembly 38 includes a roller 48 mounted on a pin 50 which extends through an arm 52 defined by a pair of links 54, 56. Pin 50 extends through locking bar 14 (16) so that one end of arm 52 is pivotably coupled to the locking bar and moves vertically with the locking bar. The other end of arm 52 is pivotably mounted by pin 51 on a stationary chamber block weldment 26. As shown in FIGS. 4A and 4B the door 12 and locking bars 14, 16 are in their lowermost or down positions whereby roller 48 contacts a striker plate 58 which is secured to a face of the door block weldment 32.

Figure 5:
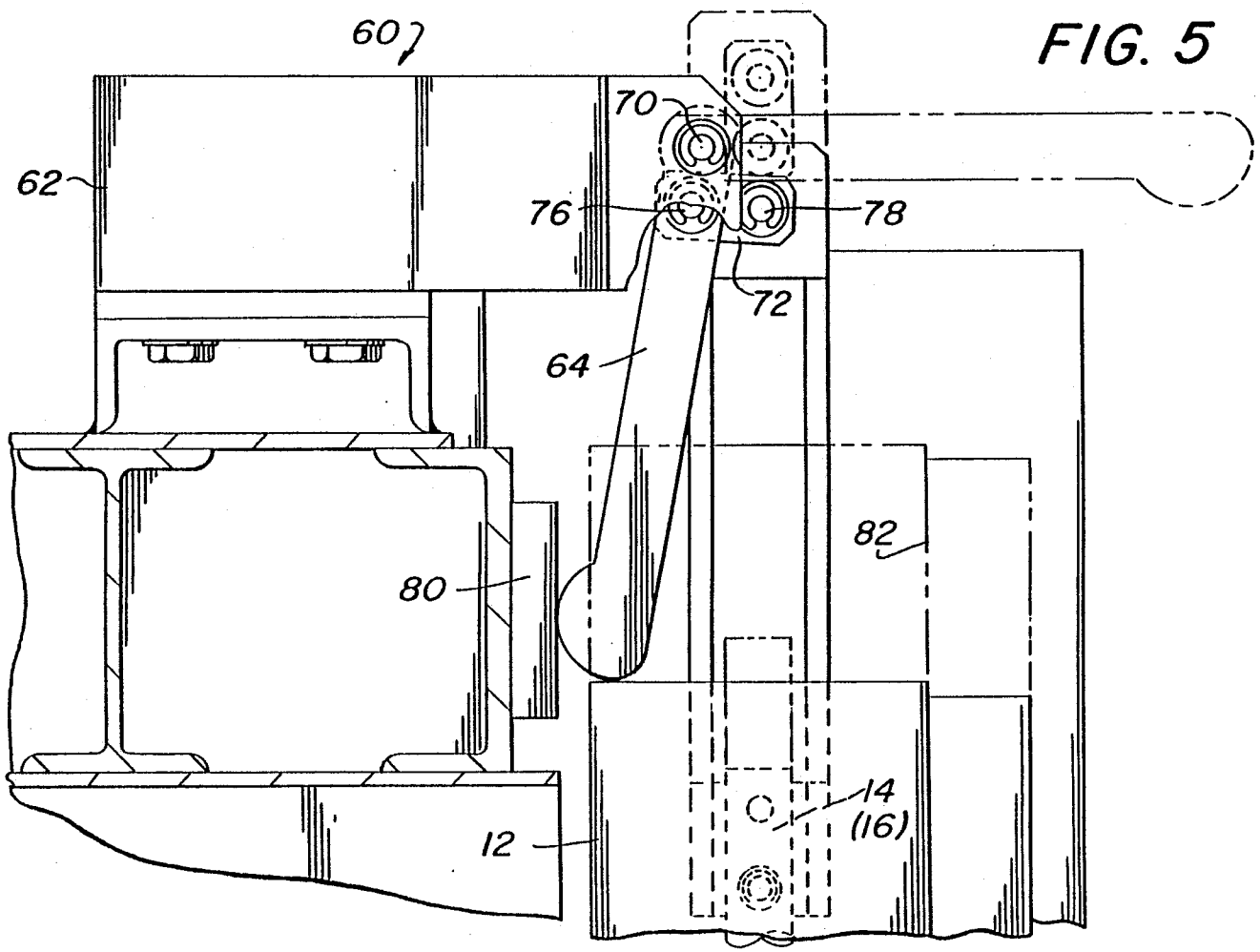
FIG. 5 is a side elevation of the door lock of the present invention.

The door lock of the present invention is shown in FIG. 5 and is designated generally as 60. Although only one door lock 60 is shown in FIG. 3, two such door locks may be used each being associated with one of the locking bars 14 (16). The door lock 60 includes a support bracket 62 mounted on the top of the chamber 10. A cam beam 64 is pivotably mounted on the upper end of the bracket 62. The cam beam is mounted on a pin 70. The cam beam 64 is coupled by a pivot link 72 to locking bar 14 (16). The link is pivotably connected at one end on a pin 76 to cam beam 64. The link is pivotably connected at its other end on a pin 78 to locking bar 14 (16). The bottom end of the locking bar 14 (16) is coupled in conventional manner by a clevis 80 to the hydraulic cylinder 18 (20). See FIG. 3.

Figure 6:
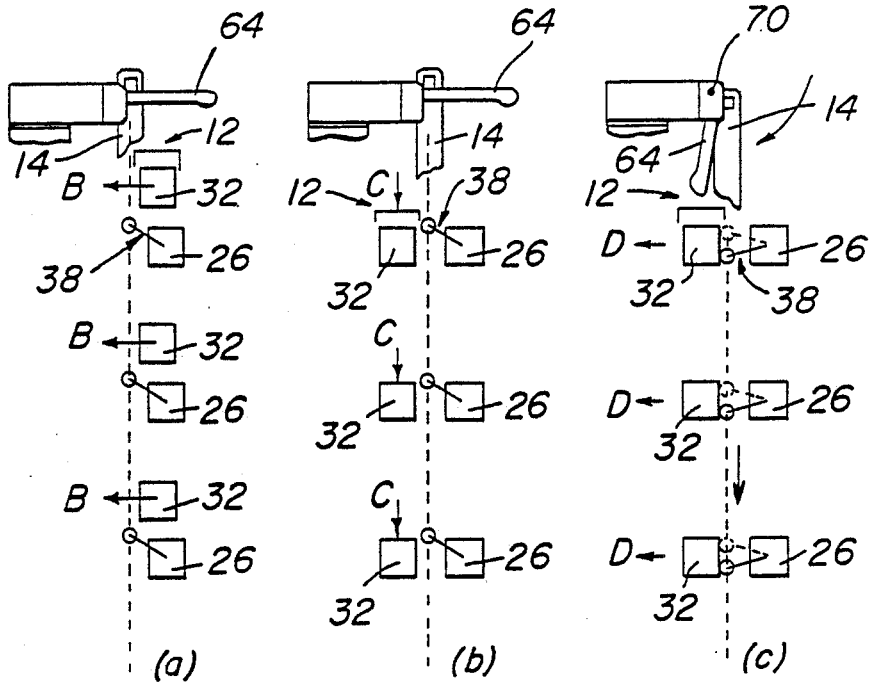
FIGS. 6(*a*)–(*c*) are schematics showing closure of the chamber door in accordance with the present invention.

Operation of the door lock 60 of the present invention as the door 12 is being closed is shown in FIG. 6. It is assumed that the door 12 has previously been swung to the open position shown in FIG. 1 and that the cam beam 64 has been swung to its uppermost or clearance position so that it is cleared from the top of the door. To close the door 12 and seal the chamber face 22, the door is first swung to a closed position. The door block weldments 32 will swing past the chamber block weldments 26 and roller assemblies 38, as indicated by arrows B, since the door 12 is maintained in its uppermost or up position by cylinder 35. The locking bar 14 (16) is maintained in its uppermost or up position by cylinder 18 (20) so that the roller assemblies 38 are canted slightly upward. When the door 12 has been swung closed against the chamber face 22, the cylinder 35 is actuated to pull the door downwardly to its lowermost or down position as indicated by arrows C. The locking bar 14 (16) remains in its uppermost position until the door 12 reaches its lowermost position. Thereafter, the cylinder 18 (20) is actuated to pull down the locking bar 14 (16) to its lowermost position. The roller assemblies 38 are swung counterclockwise. Each roller 48 contacts an associated striker plate 58 on a door block weldment 32 thereby urging or camming the door against the chamber face as indicated by arrows D. As the locking bar 14 (16) descends, cam beam 64 is swung clockwise past an over-the-center position defined by a vertical plane passing through pivot pin 70 orthogonal to the plane of FIG. 6(*c*). When the locking bar 14 (16) reaches its lowermost position, cam beam 64 is in the limit stop position shown in FIG. 6(*c*). The free end of the cam beam 64 is blocked by a stop 80 (FIG. 5) and is disposed above and is spaced from the top of the door by a slight clearance. If the door 12 has been pulled to its lowermost position when the locking bar 14 (16) starts to descend, the free end of the cam beam 64 will not contact the door as cam beam moves in an arc from the clearance positions shown in FIGS. 6(*a*) and (*b*) to the limit stop position shown in FIG. 6(*c*).

If the door 12 is near but not at its lowermost position when the locking bars begin to descend, the free end of the cam beam 64 will contact the top of the door during clockwise movement of the cam beam through the over-the-center position. As the free end of the cam beam contacts the top of the door, it tends to urge or cam the door downwardly to its lowermost position. The conventional control for the door cylinder prevents the door from moving downwardly when the locking bars are operating. However, minor modifications can be made to the conventional control so as to enable the door cylinder to accommodate downward movement of the door, under force of the cam beam 64, when the locking bars are operating (descending) thereby ensuring that the door block weldments will descend to their proper positions as the locking bars reach their lowermost positions. As the door reaches its lowermost position, the cam beam 64 continues to travel clockwise (CW) about pivot pin 70 until it reaches the limit stop position shown in FIG. 6(*c*) wherein it is blocked by stop 80 (FIG. 5) and disposed to the left of the over-the-center position and above and at a slight clearance from the top of the door.

If the door cylinder 35 is mistakenly activated during chamber pressurization, before the locking bars have been raised, cam beam 64 will serve as a limit stop preventing any substantial upward movement of the door 12. Thus, the door 12 will rise and strike the cam beam, urging the cam beam against stop 80 (FIG. 5). This blocks any further movement of the door.

If the door 12 is obstructed so that it is not near its lowermost position when the locking bars begin to descend, the cam beam 64 will strike the door 12 on a front face portion 82 thereby obstructing further movement of the cam beam hence locking bars. This prevents the locking bars from approaching their lowermost positions and tripping the limit switches (not shown) which in turn prevents the operator from initiating chamber pressurization via the operator controls. The operator would have to remove the cause of obstruction of the door to allow the locking bars to descend and trip the limit switches in order to pressurize the chamber.

Figure 7:
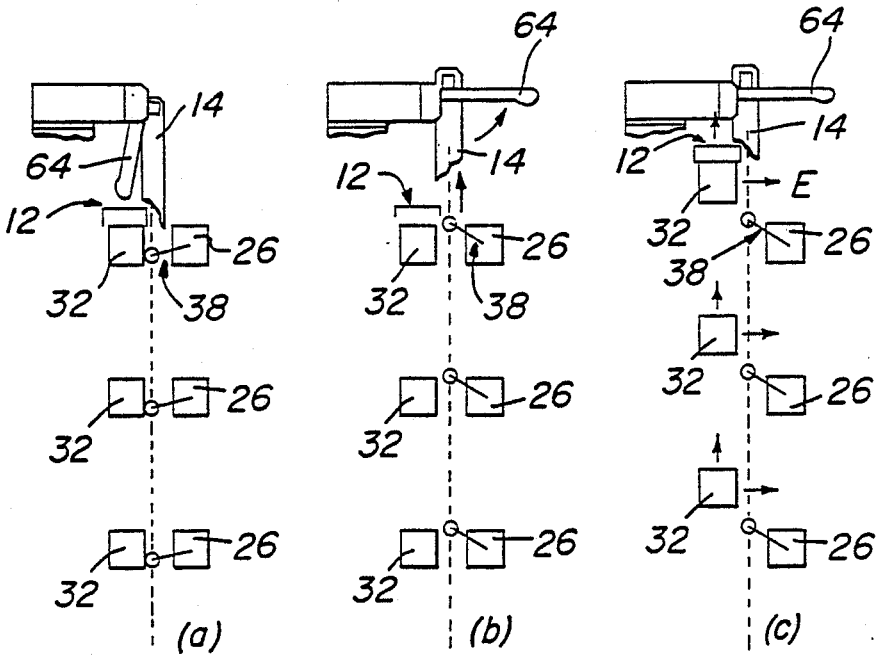
FIG. 7(*a*)-(*c*) is a schematic showing opening of the chamber door in accordance with the present invention.

Operation of the door lock 60 of the present invention as the door 12 is being opened is shown in FIG. 7. Initially, the door 12 is in the closed position so that the cam beam 64 and roller assemblies 38 are arranged as shown in FIG. 7(*a*). To unlock the door so that it can be swung open, the operator actuates the cylinder 18 (20) so as to drive the locking bars upwardly. As the locking bars ascend, the roller assemblies 38 clear the door block weldments 32. At the same time, the cam beam 64 swings CCW from the limit stop position past the over-the-center position to the uppermost or clearance position shown in FIG. 7(*b*). The door cylinder 35 is then activated to drive the hinge pin 34 and door 12 upwardly. When door 12 reaches its uppermost position, the door block weldments 32 clear the associated chamber block weldments 26 and roller assemblies 38 so that the door can then be swung open either manually or automatically in the direction indicated by arrow E.

The present invention may be embodied in other specific forms without departing from the spirit or essential attributes thereof and, accordingly, reference should be made to the appended claims, rather than to the foregoing specification, as indicating the scope of the invention.

We claim:

1. Locking apparatus for a chamber door movable vertically between up and down positions with respect to a chamber and swingable about a vertical axis to and from a face of the chamber, comprising:

a locking bar movable vertically between up and down positions and spaced roller assemblies pivotably mounted on said locking bar so as to contact a portion of said chamber door and urge said door against said chamber face when said door and locking bar are in down positions and so as to clear said portion of said chamber door so that said door can be swung from said chamber face when said door and locking bar are in said up positions, and means coupled to said locking bar for obstructing upward movement of said door when said door and locking bar are in said down positions and for permitting unobstructed upward movement of said when said locking bar is in said up position.

2. Locking apparatus according to claim 1 wherein said means includes a member coupled to said locking bar and movable between a limit stop position wherein the member obstructs upward movement of the door and a clearance position wherein the member does not obstruct upward movement of the door.

3. Locking apparatus according to claim 1 wherein said means includes means for obstructing downward movement of said locking bar when said door is between said up and down position and for permitting unobstructed downward movement of said locking bar when said door is in said down position.

4. Locking apparatus for a chamber door movable vertically between up and down positions with respect to a chamber and swingable about a vertical axis to and from a face of the chamber, comprising:

a locking bar movable vertically between up and down positions and spaced roller assemblies pivotably mounted on said locking bar so as to contact a portion of said chamber door and urge said door against said chamber face when said door and locking bar are in said down positions and so as to clear said portion of said chamber door so that said door can be swung from said chamber face when said door and locking bar are in said up positions, and a member coupled to said locking bar such that said member and locking bar move in synchronism and movement of said locking bar to said down position when the door is in said down position causes said member to move from a clearance position wherein the member does not obstruct upward movement of the door to a limit stop position wherein the member obstructs upward movement of the door.

5. Locking apparatus for a chamber door movably vertically between up and down positions with respect to a chamber and swingable about a vertical axis to and from a face of the chamber, comprising:

a locking bar movable vertically between up and down positions, means coupled to said locking bar for urging said door against the chamber face when said door and locking bar are in said down positions, and a member coupled to said locking bar such that movement of said locking bar from said up position to said down position when said door is in the down position causes said member to move from a clearance position wherein the member does not obstruct upward movement of the door to a limit stop position wherein the member obstructs upward movement of the door.

6. Locking apparatus according to claims 4 or 5 wherein said member and locking bar are coupled such that downward movement of said locking bar moves said member to and into contact with said door when the door is between said up and down position whereby said door obstructs further movement of said member and locking bar.

7. Locking apparatus for a chamber door movable vertically between up an down positions with respect to a chamber and swingable about a vertical axis to and from a face of a chamber, comprising:

a locking bar movable vertically between up and down positions and spaced roller assemblies pivotably mounted on said locking bar so as to contact a portion of said chamber door and urge said door against said member face when said door and locking bar are in said down positions and so as to clear said portion of said chamber door so that said door can be swung from said chamber face when said door and locking bar are in said up positions, and means coupled to said locking bar for striking said door and thereby obstructing downward movement of said locking bar from said up position when said door is between said up and down positions and for clearing said door and thereby permit unobstructed downward movement of said locking bar when said door is in said down position.

8. Locking apparatus according to claim 8 wherein said means includes a member movable to and away from said door, said member and locking bar being coupled such that downward movement of said locking bar moves said member into contact with said door when the door is between said up and down positions whereby said door obstructs further movement of said member and said locking bar.

9. Locking apparatus according to claim 7 wherein said means is coupled to said locking bar so as to limit upward movement of said door when said door and locking bar are in said down positions and permit upward movement of said door when said locking bar is in said up position.

10. Locking apparatus according to any one of claims 2, 4, 5 and 8 wherein said member and locking bar are coupled such that movement of said locking bar to said down position causes said member to move into camming contact with said door when said door is above and near said down position so as to said door to said down position.

11. Locking apparatus for a chamber door movable vertically between up and down positions with respect to a chamber and swingable about a vertical axis to and from a face of the chamber, comprising:

a locking bar movable vertically between up and down positions and spaced roller assemblies pivotably mounted on said locking bar so as to contact a portion of said chamber door and urge said door against said chamber face when said door and locking bar are in said down positions and so as to clear said portion of said chamber door so that said door can be swung from said chamber face when said door and locking bar are in said up positions, and means coupled to said locking bar for cammingly contacting the door as said locking bar moves downwardly when said door is above and near said down position so as to urge said door to said down position.

12. Locking apparatus according to claim 11 wherein said means is coupled to said locking bar so as to strike said door and thereby obstruct downward movement of said locking bar when said door is between said up and down positions and permit unobstructed downward movement of said locking bar when said door is in down position.

13. Locking apparatus according to claim 11 wherein said means is coupled to said locking door so as to obstruct upward movement of said door when said door and locking bar are in said down positions and permit obstructed downward movement of said door when said locking bar is in said up position.

14. Locking apparatus according to claim 13 where in said means includes a member coupled to said locking bar and movable between a limit stop position wherein the member obstructs upward movement of the door and a clearance position wherein the member does not obstruct upward movement of the door.

* * * * *